US011111684B2

(12) United States Patent
Khamis et al.

(10) Patent No.: US 11,111,684 B2
(45) Date of Patent: Sep. 7, 2021

(54) PREFORMED SWIMMING POOL BODY HAVING A BUILT-IN PIT

(71) Applicants: William Khamis, Fortville, IN (US); Edward Vondell, Fishers, IN (US)

(72) Inventors: William Khamis, Fortville, IN (US); Edward Vondell, Fishers, IN (US)

( * ) Notice: Subject to any disclaimer, the term of this patent is extended or adjusted under 35 U.S.C. 154(b) by 66 days.

(21) Appl. No.: 16/100,879

(22) Filed: Aug. 10, 2018

(65) Prior Publication Data

US 2019/0136561 A1 May 9, 2019

Related U.S. Application Data

(63) Continuation-in-part of application No. 15/801,771, filed on Nov. 2, 2017, now Pat. No. 10,450,766.

(51) Int. Cl.
*E04H 4/14* (2006.01)
*E04H 4/00* (2006.01)

(52) U.S. Cl.
CPC ..... *E04H 4/144* (2013.01); *E04H 4/0037* (2013.01)

(58) Field of Classification Search
CPC ..... E04H 4/144; E04H 4/14; E04H 4/0037
See application file for complete search history.

(56) References Cited

U.S. PATENT DOCUMENTS 3,793,653 A 2/1974 Brooks
4,599,835 A 7/1986 Rinke
5,720,056 A * 2/1998 Aymes ..... E04H 4/005 4/488
5,727,264 A * 3/1998 Craig ..... E04H 4/0037 4/489
9,192,881 B2 * 11/2015 Adkins ..... B01D 35/02
10,494,771 B1 * 12/2019 Powell ..... E04H 3/12
2007/0039091 A1 2/2007 Foy
2008/0120928 A1 5/2008 St. Pierre
2009/0151066 A1 6/2009 Sullivan
2018/0148945 A1 * 5/2018 Roux ..... E04H 4/0018

* cited by examiner

*Primary Examiner* — Janie M Loeppke

(74) *Attorney, Agent, or Firm* — C. John Brannon; Brannon Sowers & Cracraft PC

(57) ABSTRACT

A swimming pool assembly, including a pool body defining a pool top edge and an opposite pool floor member connected by at least one pool wall, a dry area formed within the pool body and defining a dry area wall portion, a dry area bottom portion operationally connected thereto, and an aperture operationally connected to the dry area bottom portion for providing fluid communication from the dry area into the support structure. The dry area includes seating and a central feature, such as a fire pit, pool table, wet bar, or the like. A support structure is provided to support the dry area and is connected to the dry area bottom portion. The support structure further includes a support structure floor member, at least one support structure wall member extending therefrom and connected to the shallow deck portion to define an enclosure, and at least one fluid access aperture formed through the support structure wall member to provide fluidic communication with the enclosure.

10 Claims, 12 Drawing Sheets

PREFORMED SWIMMING POOL BODY HAVING A BUILT-IN PIT

CROSS-REFERENCE TO RELATED APPLICATIONS

This patent application is a continuation-in-part of, and claims priority to, U.S. patent application Ser. No. 15/801,771, filed on Nov. 2, 2017.

TECHNICAL FIELD

The present novel technology relates generally to the field of excavation, and, more particularly, to a method and apparatus for the stabilization and support of in-ground fiberglass pool bodies having preformed pits.

BACKGROUND

Preformed fiberglass swimming pools offer many advantages over vinyl liner and in-situ formed shotcrete or concrete walled swimming pools. Fiberglass pool bodies may be quickly and inexpensively formed and require considerably less effort to put into the ground. Recently, there has been increased interest in fiberglass pool bodies having a preformed shallow flat portion, or tanning ledge or deck, upon which pool users may lay for sun-tanning purposes, allowing water to lap them without submerging them.

There has been increasing interest among homeowners regarding enjoying the aesthetic aspects of being in a swimming pool while remaining dry. This has resulted in an interest in fiberglass swimming pool bodies having preformed features, such as a sunken pit offering a dry oasis surrounded by pool water. Ideally, such a pit may include seating and a central table or fire pit. Upon installation, these features effectively define uneven pockets or crawlspaces that must be backfilled to provide sufficient support therefor. Typical material, such as sand or gravel, is difficult to properly and evenly distribute in such odd spaces, and backfilling is typically performed by one or more workmen crammed into the workspace to manually direct and distribute the backfill. Gravel backfill is preferred as it is less prone to flowing and settling, but is harder to evenly distribute under a tanning ledge or pit feature, and requires manual distribution by workmen. Backfilling with a flowable material, such as concrete, removes the need for a workman, but is very costly. Further, backfilling the space with any material, such as gravel, sand, concrete or the like typically leaves a significant top void which results in the feature being insufficiently supported, or completely unsupported, especially after the pool seasons and settles, leading to flexure and sagging of the features.

Thus, there remains a need for a method and apparatus that would allow easy installation of the pool body with proper support of unusual or irregular features. The present novel technology addresses this need.

DETAILED DESCRIPTION OF THE PREFERRED EMBODIMENT

Figure 1:
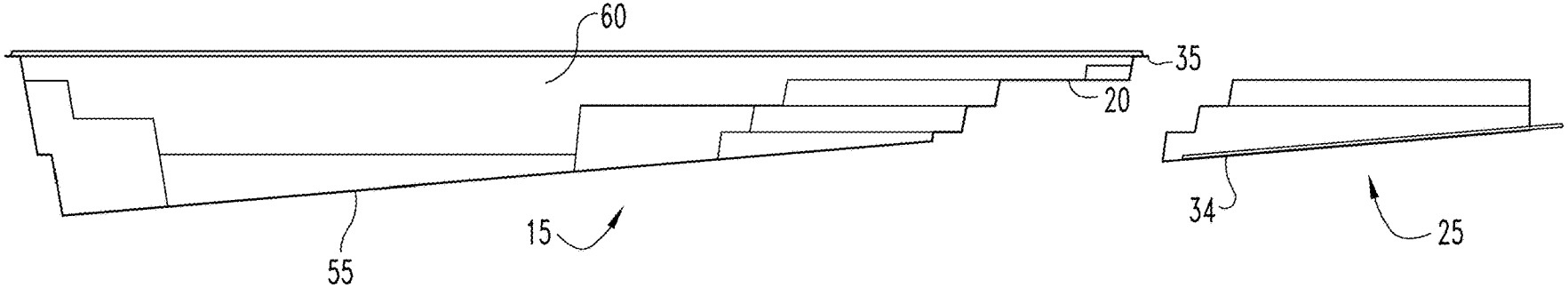
FIG. 1 is a side elevation view of a first embodiment fiberglass pool assembly of the present novel technology.
Figure 2:
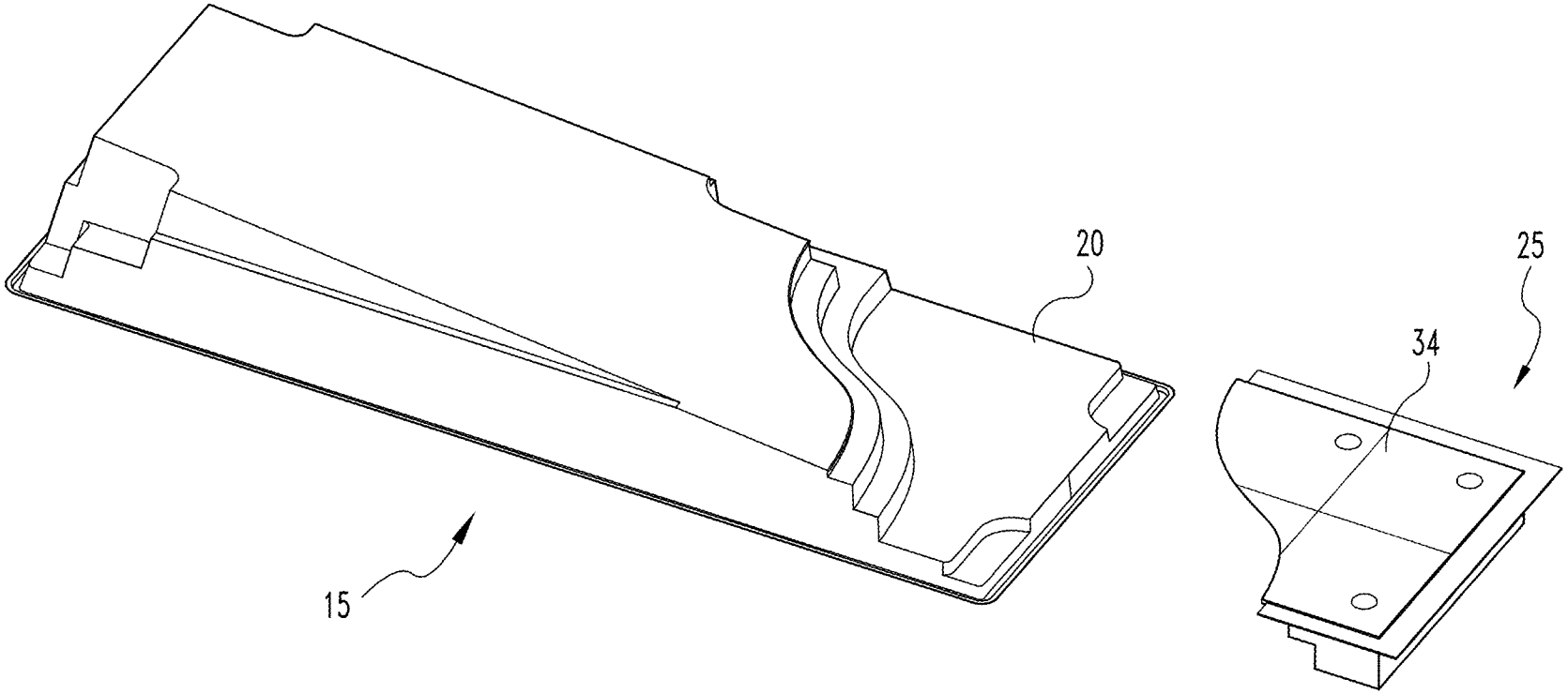
FIG. 2 is a bottom perspective view of the pool assembly of FIG. 1.
Figure 3:
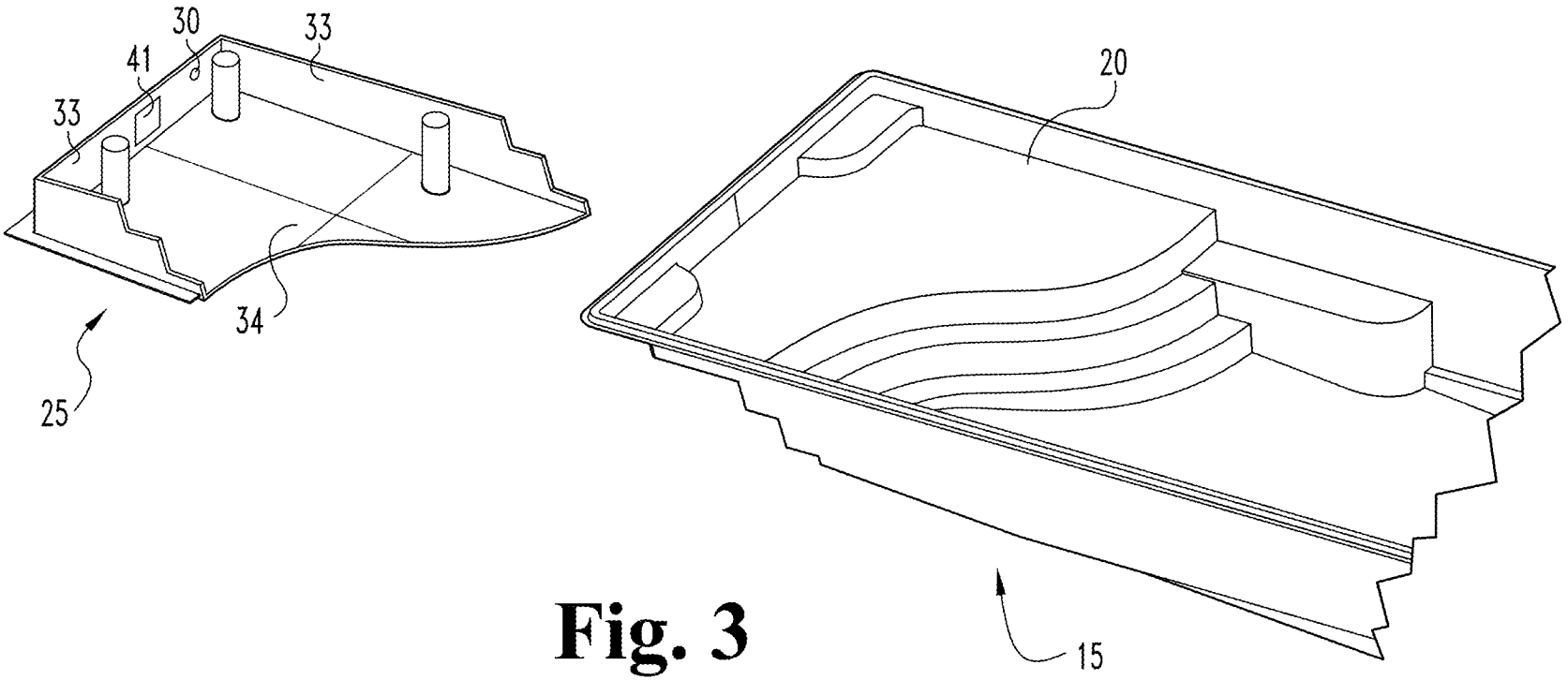
FIG. 3 is a top perspective partial cutaway view of the curtain of FIG. 1.
Figure 4:
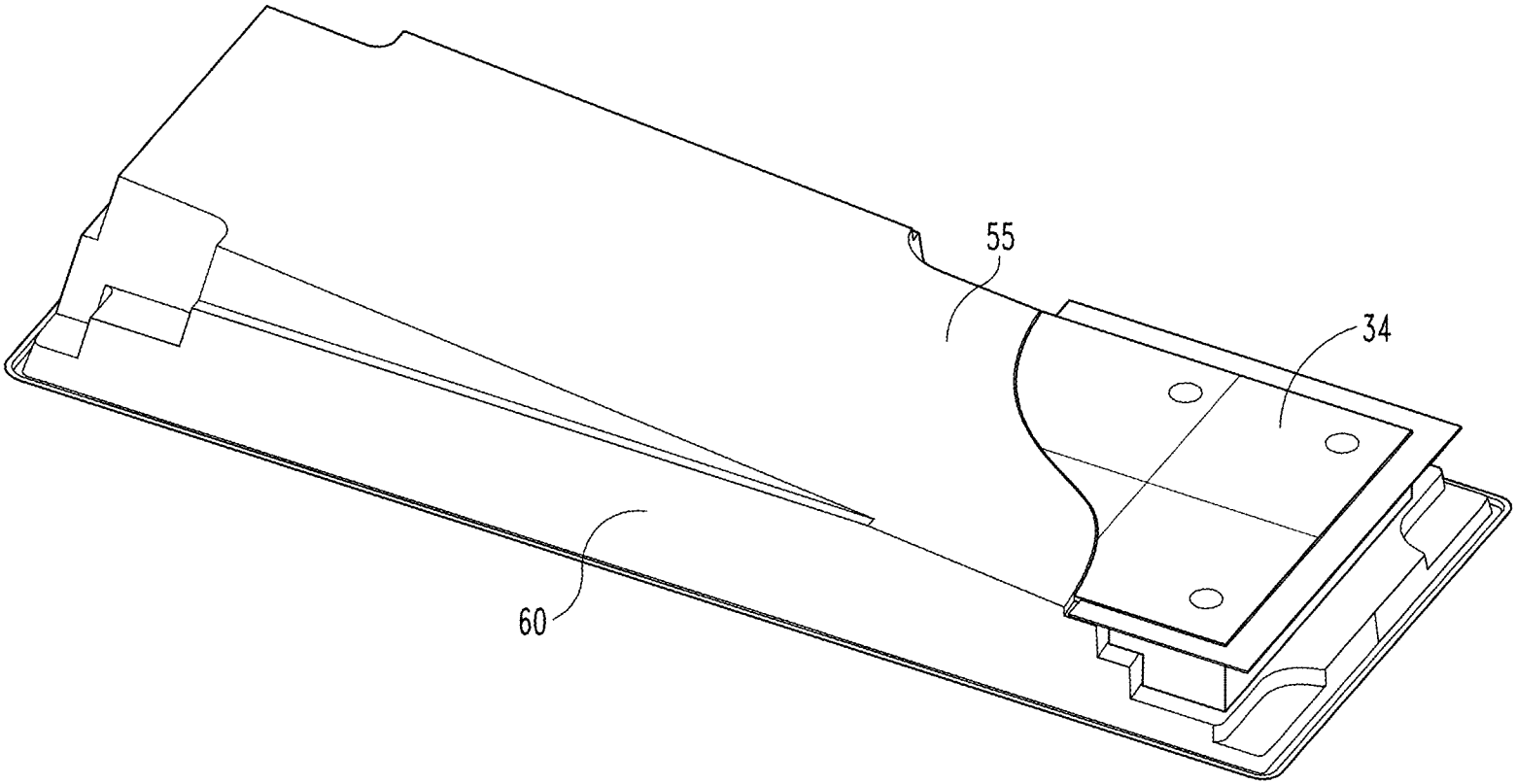
FIG. 4 is a bottom perspective view of the pool assembly of FIG. 2 with the support structure engaged to the fiberglass pool body.
Figure 5:
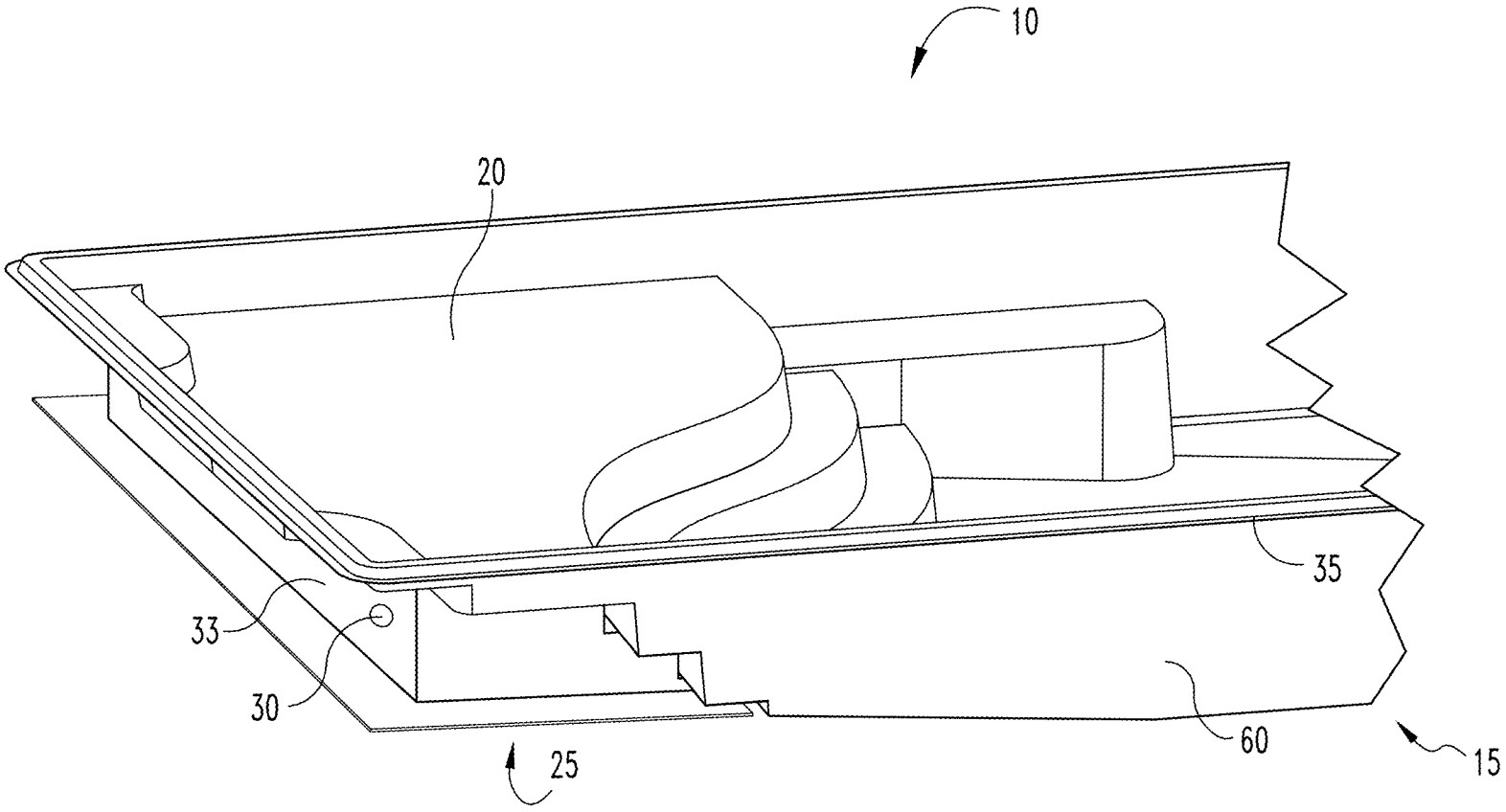
FIG. 5 is a top perspective view of the pool assembly of FIG. 3 with the support structure engaged to the fiberglass pool body.
Figure 6:
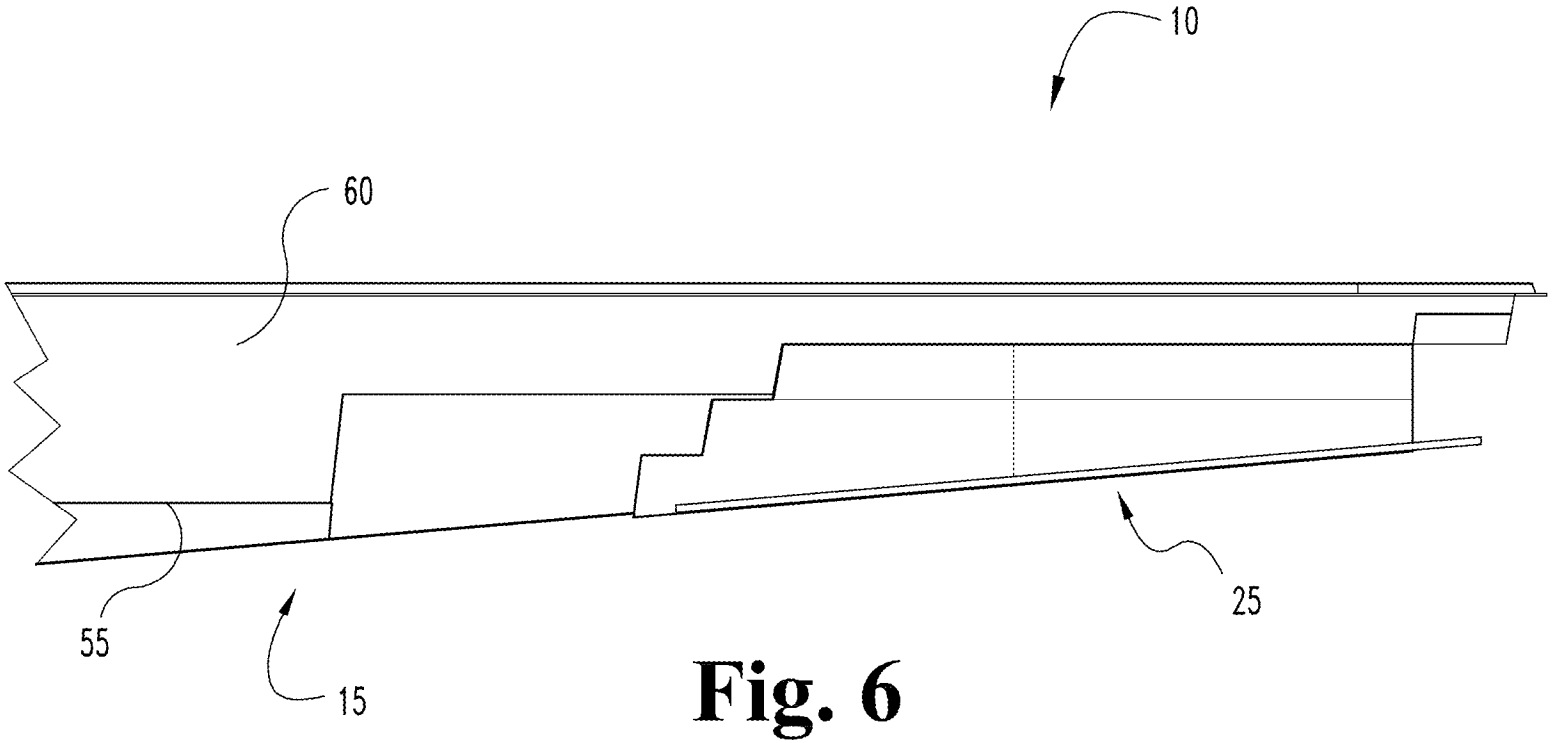
FIG. 6 is a side elevation view of the pool assembly of FIG. 1 with the support structure engaged to the fiberglass pool body.
Figure 7:
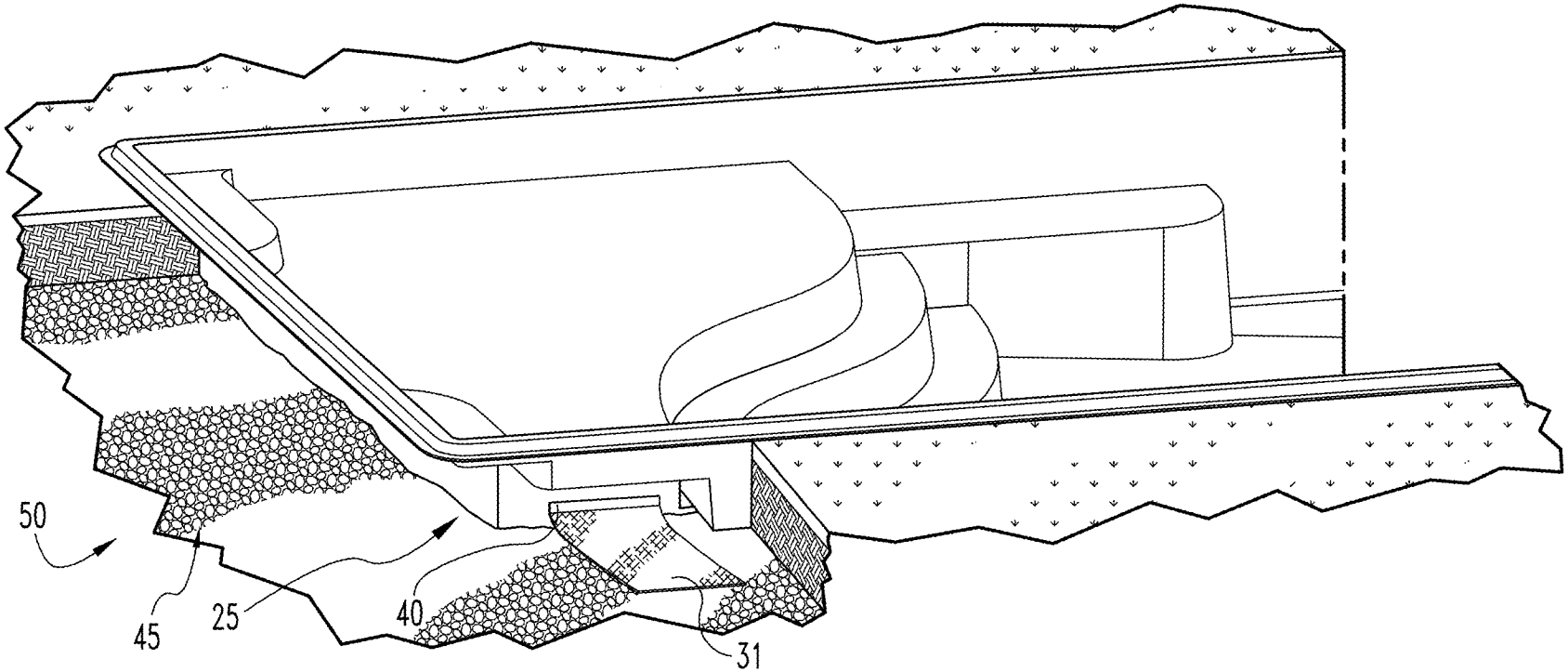
FIG. 7 is a top perspective partial cutaway view of the pool assembly of FIG. 3 with the support structure engaged to the fiberglass pool body and emplaced in the ground.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

The present novel technology relates to an assembly 10 for assisting in the mounting or installation of a fiberglass or like preformed swimming pool body 15 having a protruding or extending shallow tanning ledge or deck portion 20 into a freshly dug excavation, and includes a support structure 25 fixedly connectible to the deck portion 20 for providing support for the deck portion 20 when the pool body 15 is installed in an excavation. The support structure 25 is typically a generally hollow housing or body 25 with one or more apertures 30 formed therethrough and is typically made of a lightweight structural material, such as fiberglass, aluminum, or the like. Typically, at least one, and more typically a plurality, flexible, tough sheet segment 31 is securely bonded to one or more exterior sidewalls 33 of the support structure 25 for extension therefrom. The support structure further typically includes a floor member 34 from which the sidewall/sidewalls 33 extend to define an open-topped enclosure. The pool tanning ledge or deck 20, when connected to the support structure 25, defines an enclosing top wall or ceiling portion 20.

Typically, an anchor member 31, such as one or more flexible sheets of geotextile, fiberglass, or like material and/or a rigid anchoring flange formed from fiberglass, aluminum, or like material, or the like, is operationally connected to the support structure 25 floor member 34 and/or at one or more exterior sidewalls 33. In the case of flexible sheet members 31, the sheets 31 are typically positioned at one or more different elevations (distances from the top lip 35 of the pool body 15 when oriented for positioning in the ground) and are spaced around the support structure perimeter. After the pool body 15 is positioned into the excavation, the excavation around the pool body 15 is backfilled (typically with gravel) to cover the anchor member 31 to thus provide a downward force to counter any buoyancy forces that may be generated by groundwater. If flexible sheets 31 are buried in backfill, the weight of the soil pressing on the extended sheets 31, as securely bonded to the fiberglass outer walls 31, is sufficient to generate an outward and downward force on the walls 31 to at least partially counter the upwardly directed buoyancy force produced by groundwater around the pool body 15, which is non-negligible when the pool body is underfilled with water. Optionally, the backfill may be compacted manually or with a mechanical compactor at one or more points during the backfilling process.

The anchor member(s) 31 is typically securely bonded to an exterior sidewall 33 and/or floor member 34, such as by an additional application of fiberglass fusion bonds or volumes 40, by an adhesive material bond 40, or the like.

In operation, the support structure 25 is typically installed when the pool is produced or as an after-market upgrade, or may even be formed as a unitary part of the fiberglass pool body 15 during manufacture. Typically, the support structure 25 is adhered to the pool body 15 under the tanning deck 20 by fiberglass fusion bonds 40 or like adhesive materials 40 prior to the pool body 15 being emplaced in an excavation, so that the pool body may be level and feel rigid and solidly supported when a person walks onto the tanning ledge 20. Typically, the pool body has a bottom member or floor 55 and at least one pool wall 60 extending from the floor member 55 to the top lip 35; the pool body bottom member 55 and the support structure floor member typically extend equidistantly from the top lip 35 to make excavation simpler. However, the excavation may be formed to approximate the shape of the pool body 15, including the shallow tanning ledge 20, and in such cases the bottom portions 34, 55 are positioned at different distances from the top lip 35 (or, in other words, the support structure 25 is shorter). The support structure 25 thus reduces the amount of backfill material necessary to install the pool body 15 while providing structural support beneath the tanning ledge 20 to support the weight of water and/or swimmers. The support structure 25 also allows for installers to have better access to drill holes for water jets and/or bubblers.

Once installed, the apertures 30 allow for water supplied during installation and ambient groundwater to fill the hollow support structure 25 to further weigh down the support structure 25, countering the upwardly-directed buoyancy forces urging the pool body out of the ground. Groundwater freely flows into and out of the apertures 30 such that the effects of stagnant water and buoyancy are both reduced or eliminated.

As the anchor member(s) 31 extend(s) from the support structure body 25 and into the excavation into which the pool body 15 has been placed, backfill is poured to partially fill the excavation. The outwardly extending anchor member (s) 31 is covered by backfill and remain(s) anchored in place. The weight of the backfill material on the anchor member(s) 31 generates a frictional anchoring force thereupon that resists movement of the anchor member(s) 31, thus creating a downward or pulling force on the exterior bottom floor member 34 and/or the sidewalls 33 to oppose any pushing force generated by buoyance thereagainst.

In some embodiments, an access point or hatch 41 is formed through the support structure 25 (typically through a sidewall 33) to allow a workman, such as a plumber, entry thereinto.

This process may define a method of stabilizing the tanning deck 20 of a preformed swimming pool body 15, including bonding a support structure 20 to the pool body 15 beneath or adjacent the tanning deck portion 20, integrating an anchor member 31 to an exterior surface 33, 34 of a preformed support structure 25, and then covering the extended anchor member 31 with volume of backfill material 45. If the anchor member 31 is a sheet of geotextile or like material, the extended sheet 31 is laid out upon a first volume of backfill surface 50 and then buries under a second volume of backfill material 45. The method is continued by next bonding a second anchor sheet 31 to an exterior surface or sidewall 33, extending the second anchor sheet 31 over the second volume of backfill material 45, laying the extended second anchor sheet 31 on a second volume of backfill surface 50 and finally burying the extended second anchor sheet 31 under a third volume of backfill material 45. The anchor sheet 31 is typically a porous geotextile material. Typically, the first and subsequent anchor sheets 31 each define a plurality of geotextile segments arrayed in a row around the preformed support structure 20 and positioned substantially equidistantly from a top edge 35. The backfill material 45 is typically selected from the group comprising soil, sand, gravel, and combinations thereof. Once the anchor sheets 31 are so emplaced, backfilling is completed, and water, sand, or the like is directed to fill the support structure 20.

The pool body 15 may be of any convenient shape, including rectangular, generally rectangular, kidney shaped, round, oval, or the like. The sheets 31 may extend from opposing sidewalls 33, adjacent sidewalls 33, from random positions, or the like.

Figure 8:
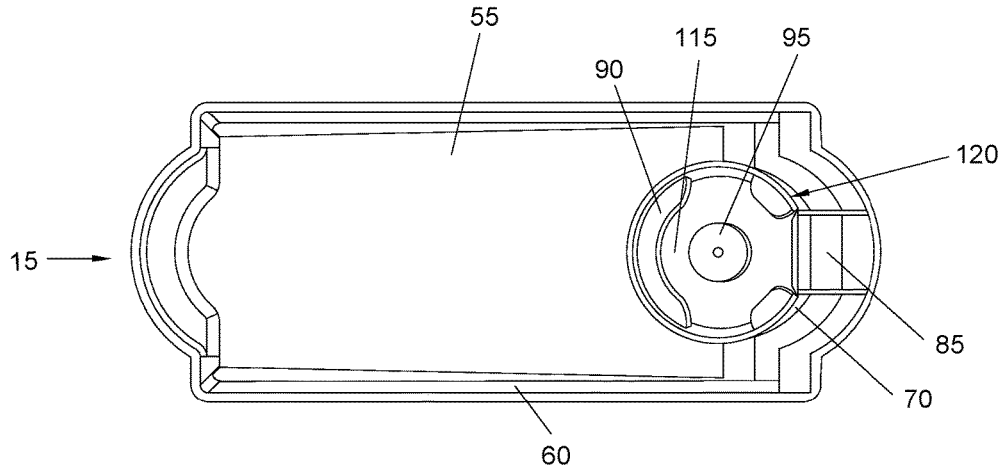
FIG. 8 is a perspective view of a second embodiment pool assembly having a support structure positioned under a modular insert.
Figure 9:
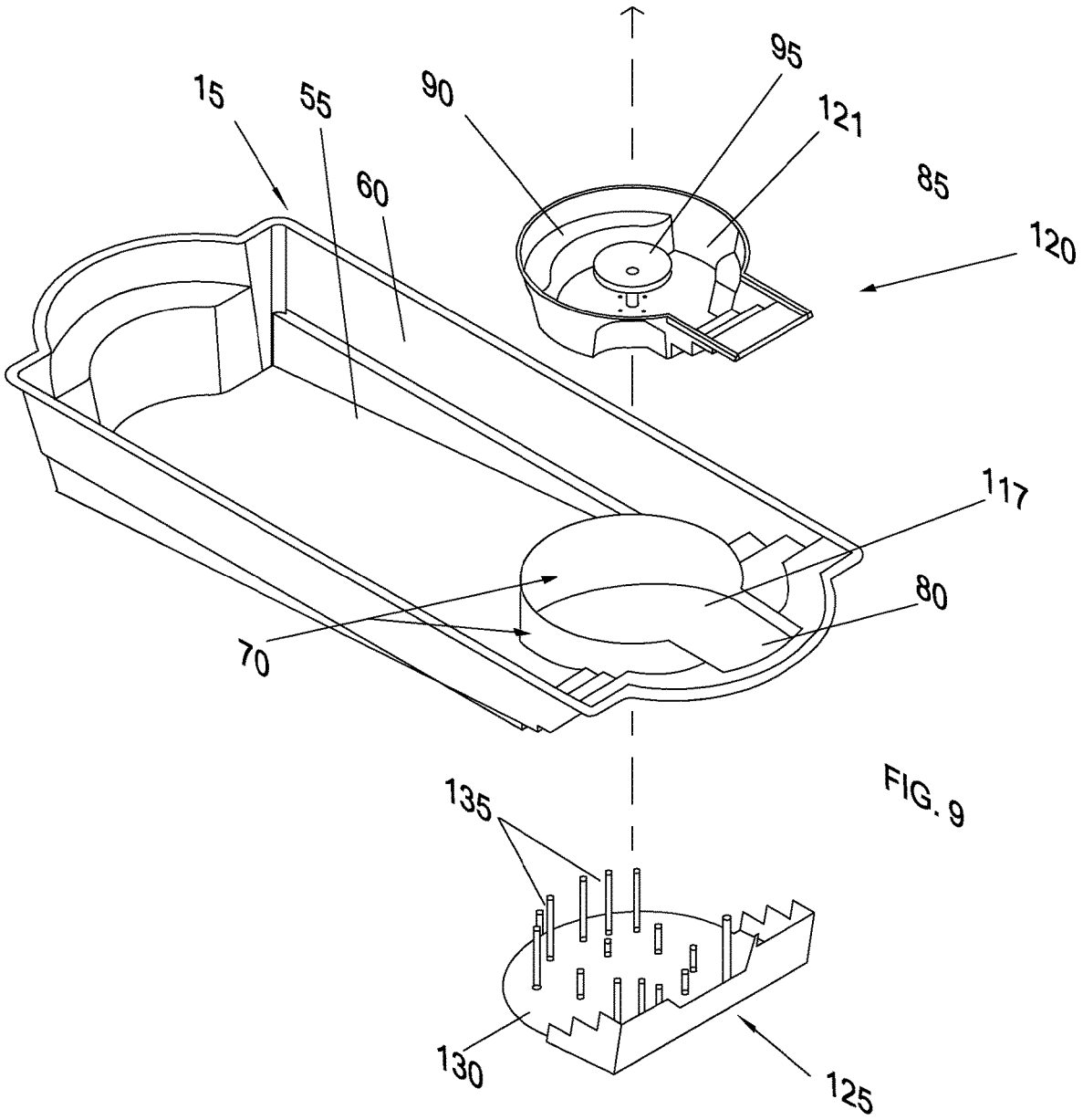
FIG. 9 is an exploded perspective view of the embodiment of FIG. 8.
Figure 10:
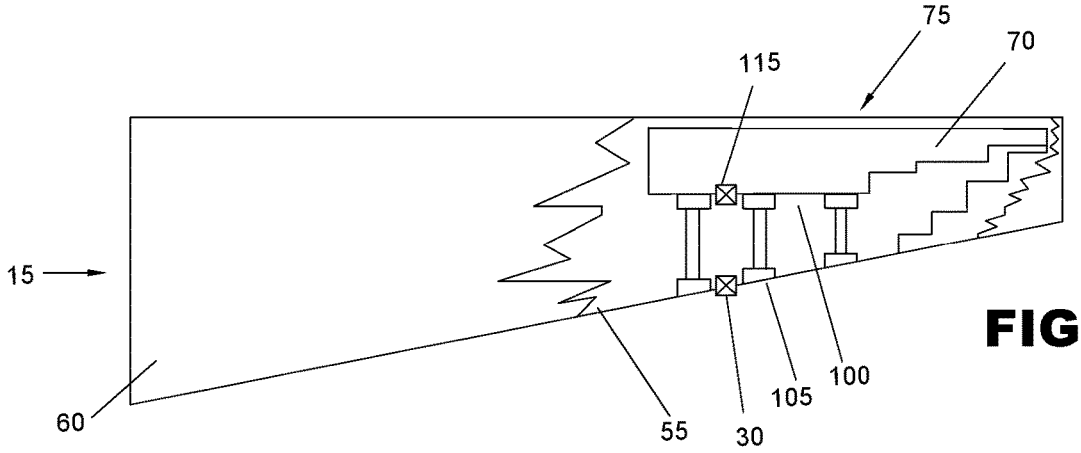
FIG. 10 is a partial cutaway side view of a third embodiment swimming pool body having a built-in dry area.
Figure 11:
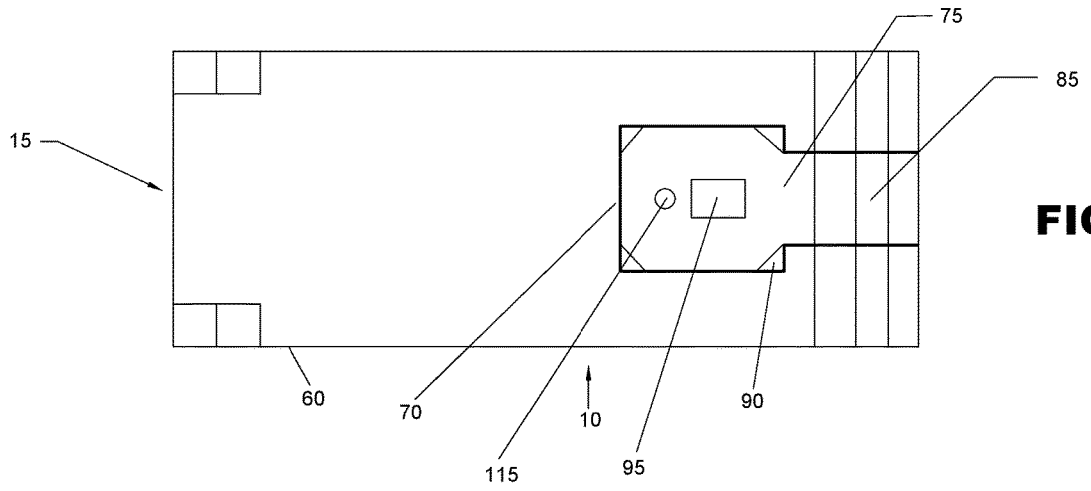
FIG. 11 is a top plan view of the embodiment of FIG. 10.
Figure 12:
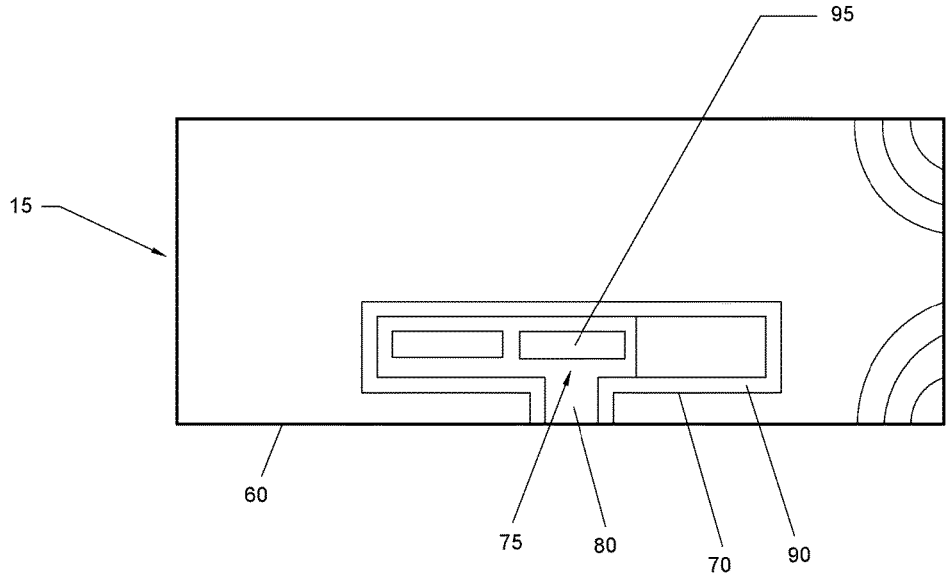
FIG. 12 is a top plan view of a fourth embodiment swimming pool body having a dry area positioned therein.

In some embodiments, as illustrated in FIGS. 8-12, the pool body 15 includes an internal, typically endless, wall 70 defining an area or portion 75 that remains free of water when the pool body 15 is filled. This dry area 75 may be isolated from the pool wall 60, or may include a (typically elongated) portion 80 extending to the wall 60. In some embodiments, the elongated portion 80 includes a set of stairs 85 preformed therein to facilitate ambulator communication with the elongated portion 80 and the dry area 75.

The dry area 75 may likewise include preformed seats or benches 90 (typically positioned adjacent the walls 70), and/or a central feature 95, such as a pool table or fire pit.

In some embodiments, the internal wall 70 is connected to the pool bottom 55, while in other embodiments the internal wall 70 is connected to a floor member 100 that is not contiguous with the pool bottom 55. The floor member 100 is elevated above the pool bottom 55, typically by one or more structural support members 105. The wall 70 typically extends to connect to the pool bottom 55, and is more typically engaged therewith to define a watertight chamber 110 beneath the dry area 75. The watertight chamber 110 is watertight with respect to the remainder of the pool body 15, but not necessarily with respect to the ground below the pool floor 55.

In some embodiments, a preformed support structure 25 is positioned below the floor member 100 instead of, or in addition to, the support member(s) 105. The support structure 25 is typically shaped to ma tingly engage the floor member 100 to provide generally evenly distributed support therefor. The support structure 25 typically includes one or more apertures 30 in fluidic communication with groundwater as discussed above; the pool bottom 55 positioned within the watertight chamber 110 likewise includes one or more apertures 30 in fluidic communication with groundwater. The floor member 100 likewise typically includes a drain aperture or check valve 115 for fluidically communicating any water gathered thereupon into the watertight chamber 110.

In some embodiments, the internal wall 70 is formed contiguous (typically unitarily) with the pool bottom 55 and extends therefrom to terminate at a distance above a maximum expected water level to define both a (typically generally cylindrical or frusto-conical) a dry area 75 as well as a (typically generally circular) aperture 117 to or through the swimming pool bottom 55. This dry area 75 is typically filled with a (typically preformed and modular) insert or structure 120, which may be made unitarily with the pool body 15 or of preformed fiberglass or any other convenient structural material or combination of materials. The structure 120 is typically textured to be slip-resistant, and may include tile, stone pavers, or like flooring and/or sidewall texturing. The structure 120 typically includes one or more of the above-disclosed features, such as benches 90, a central feature 95 (such as a fire pit, a pool table, a wet bar), a tanning ledge, and/or the like, positioned within a surrounding insert wall 121.

When the structure 120 is unitarily formed: In operation, the dry area wall 70 defines the interior boundary of the dry area 75, and may include preformed benches 90 or like seating structures, as well as preformed or later-added central structures 95, such as a fire pit, pool table, wet bar, and/or the like. The swimming pool bottom 55 extends through the dry area 75 and is supported by the support structure body 25 placed below, as described in detail above.

When the structure 120 is a modular insert: In operation, the insert wall 121 is positioned adjacent the dry area wall 70 and is connected or bonded thereto, typically with an adhesive or fiberglass bond, to define the dry area 75. A bottom support structure body 25 having a support floor member 130 from which one or more support pylons 135 extend is connected through the aperture 117 to the insert portion 120 for providing support to the insert portion 120. In some embodiments, the pool bottom 55 extends contiguously under the aperture 117, and the support structure 25 is positioned thereunder, providing support to the floor 55 and the structure 120 resting thereupon. In other embodiments, the pool floor 55 does not extend under the aperture 117, and the support structure 25 acts to partially or completely connect to the pool bottom 55 to partially or completely close the aperture 117. The support structure body 25 is typically bonded to the pool bottom 55, such that the floor member 130 snugly fits with the pool bottom 55 to close the aperture 117, with each pylon 135 positioned in contact with the insert 120. Features such as (typically low voltage) lighting, a gas line, speakers, an entertainment system, and the like may be operationally connected in the dry area 75.

While in most embodiments, the dry area structure 120 is either integrally formed with the pool body 15 or built as a module and inserted and bonded thereinto by the pool manufacturer before in-ground installation of the pool 10, the modular structure 120 may be provided as a kit to be installed on site prior to, during, or after in-ground installation of the swimming pool body 15.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

We claim:

1. A swimming pool assembly, comprising:

a swimming pool body defining a pool top edge and an oppositely disposed bottom pool floor member connected by at least one pool wall;

a dry area formed within the swimming pool body and defining a dry area wall portion; a dry area bottom portion operationally connected thereto; and an aperture operationally connected to the dry area bottom portion for providing fluid communication from the dry area into a support structure;

the support structure for providing support to the dry area operationally connected to the dry area bottom portion, wherein the support structure further comprises:

a support structure floor member;

at least one support structure wall member extending therefrom and connected to the pool top edge to define an enclosure; and at least one fluid access aperture formed through the support structure wall member to provide fluidic communication with the enclosure;

wherein the dry area remains free of water when the swimming pool body is filled with water.

2. The assembly of claim 1 wherein the swimming pool body and the dry area wall portion are unitarily formed.

3. The assembly of claim 1 and further comprising a dry area insert structure positioned within the dry area and resting upon the support structure; wherein the dry area insert structure is operationally connected to the dry area wall.

4. The assembly of claim 1 and further comprising a fire pit positioned in the dry area.

5. The assembly of claim 1 and further comprising benches extending into the dry area from the dry area wall portion.

6. The assembly of claim 1 and further comprising a water pump positioned within the dry area and fluidically connected to check valve operationally connected to the dry area floor portion for keeping water out of the dry area.

7. The assembly of claim 1 wherein the pool top edge includes a shallow deck portion extending therefrom and wherein the at least one support structure wall member is operationally connected to the shallow deck portion.

8. A swimming pool assembly, comprising:

a preformed fiberglass unitary swimming pool body defining a pool top edge and an oppositely disposed bottom pool floor member connected by at least one swimming pool sidewall;

a generally frustoconical wall structure extending from the bottom pool floor member;

a dry area disposed within the frustoconical wall structure and defining a dry area wall portion;

a dry area bottom portion operationally connected thereto;

a fiberglass bench disposed within the dry area; and an aperture operationally connected to the dry area bottom portion for evacuating water from the dry area;

wherein the dry area remains free of water when the preformed fiberglass unitary swimming pool body is filled with water.

9. The swimming pool assembly of claim 8 wherein the generally frustoconical wall structure is the dry area wall portion.

10. The swimming pool assembly of claim 8 and further comprising a watertight chamber disposed beneath the dry area, wherein the watertight chamber provides support to the dry area.

* * * * *